US011555307B2

(12) United States Patent
Viebahn et al.

(10) Patent No.: US 11,555,307 B2
(45) Date of Patent: Jan. 17, 2023

(54) BRACKET AND ASSEMBLY KIT FOR CONNECTING BUILDING COMPONENTS FOR A DRYWALL CONSTRUCTION AND DRYWALL CONSTITUTED THEREWITH

(71) Applicant: Knauf Gips KG, Iphofen (DE)

(72) Inventors: Michael Viebahn, Iphofen (DE); Jens Schaper, Diespeck (DE)

(73) Assignee: Knauf Gips KG, Iphofen (DE)

( * ) Notice: Subject to any disclaimer, the term of this patent is extended or adjusted under 35 U.S.C. 154(b) by 26 days.

(21) Appl. No.: 17/046,269

(22) PCT Filed: Feb. 19, 2019

(86) PCT No.: PCT/EP2019/000047

§ 371 (c)(1),
(2) Date: Oct. 8, 2020

(87) PCT Pub. No.: WO2019/197052

PCT Pub. Date: Oct. 17, 2019

(65) Prior Publication Data

US 2021/0079648 A1 Mar. 18, 2021

(30) Foreign Application Priority Data

Apr. 11, 2018 (DE) ..... 102018002951.5

(51) Int. Cl.
*E04B 2/72* (2006.01)

(52) U.S. Cl.
CPC ..... *E04B 2/723* (2013.01); *E04B 2/721* (2013.01); *E04B 2002/725* (2013.01); *E04B 2002/726* (2013.01)

(58) Field of Classification Search
CPC .... E04B 2/723; E04B 2/721; E04B 2002/725; E04B 2002/726; E04B 2001/405; E04B 2002/7477; E04B 2/789; E04B 2/768; E04B 2/825; E04B 2/7457; E04B 2/7411; E04B 2/7459
See application file for complete search history.

(56) References Cited

U.S. PATENT DOCUMENTS

| | | | | |
|---|---|---|---|---|
| 2,321,671 | A * | 6/1943 | La Grotta | E04B 2/7854 52/242 |
| 4,835,935 | A * | 6/1989 | Murphy | E04B 1/2403 403/382 |
| 5,040,345 | A | 8/1991 | Gilmour | |
| 6,792,733 | B2 * | 9/2004 | Wheeler | E04B 2/7457 52/241 |
| 2015/0152637 | A1 | 6/2015 | Kordecki | |

FOREIGN PATENT DOCUMENTS

| | | | |
|---|---|---|---|
| EP | 1083267 | A2 | 3/2001 |
| WO | 2009089200 | A2 | 7/2009 |

* cited by examiner

*Primary Examiner* — Patrick J Maestri
(74) *Attorney, Agent, or Firm* — Mark Terry

(57) ABSTRACT

The invention relates to a bracket for connecting components for a drywall construction, in particular a bracket for a slidable fastening, preferably a slidable ceiling-side fastening, in the framework of a drywall, preferably a bracket for a drywall with a planked, preferably multi-planked, framework. Furthermore, the invention relates to an assembly kit and a drywall with at least one such bracket, as well as the use of such a bracket in dry wall construction.

21 Claims, 4 Drawing Sheets

Figure 1:
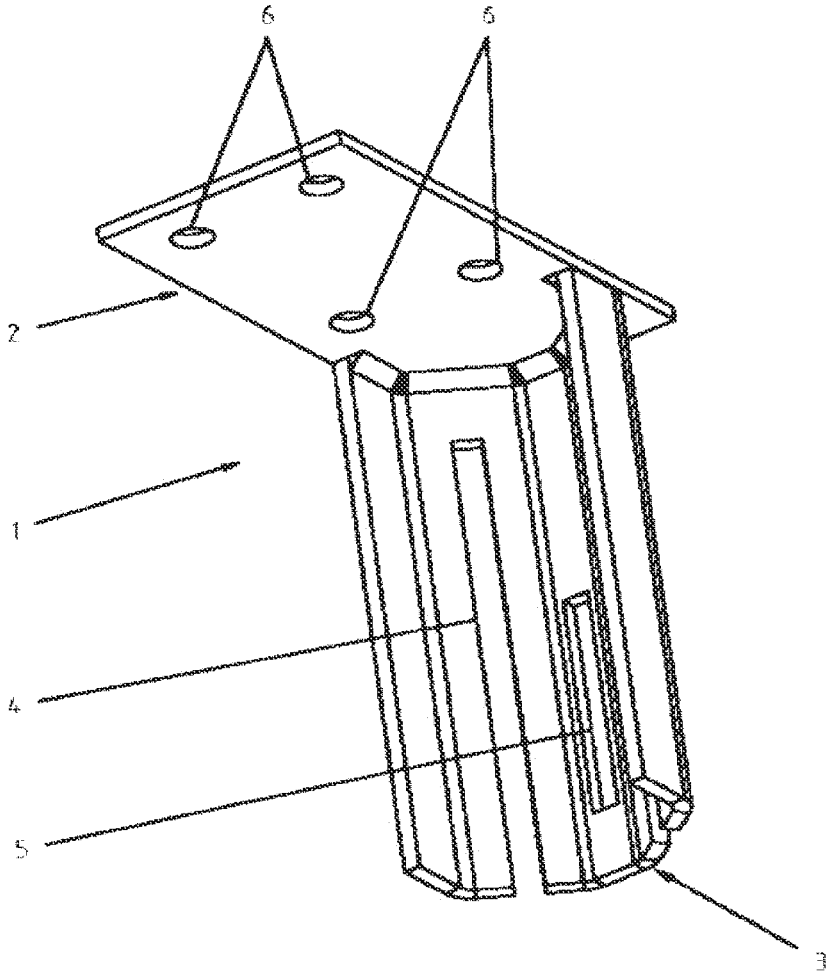

BRACKET AND ASSEMBLY KIT FOR CONNECTING BUILDING COMPONENTS FOR A DRYWALL CONSTRUCTION AND DRYWALL CONSTITUTED THEREWITH

The invention relates to a bracket for connecting building components for a drywall construction, in particular a bracket for a slidable fastening, preferably a slidable ceiling-side fastening, in the framework of a drywall, preferably a bracket for a drywall with a planked, preferably multi-planked, framework. Furthermore, the invention relates to an assembly kit and a drywall with at least one such bracket, as well as the use of such a bracket in drywall construction.

Connection elements as so-called sliding ceiling connections are used for the anticipated case of the sagging or bending-up of storey ceilings, in order with the assistance thereof to connect ceiling profiles to wall profiles in such a way that a certain vertical movement and change of spacing between the upper ends of the wall profiles and the ceiling profiles can be enabled and tolerated. The effect of this is intended to be that the connection between the wall profiles and the ceiling profiles does not become completely detached—at least up to a certain degree—in the event of loading and/or fire, which would otherwise lead to instability of the wall as such which is to be prevented, since the wall profiles would then no longer be fixed by their upper ends in a horizontal position. Deformation of ceiling profiles and/or wall profiles can occur especially in the event of fire with a large heat effect, due to weight loads, creep deformations or in the event of impacts, e.g. earthquakes or other shocks, i.e. dynamically. In such cases, a reliable, for example a strain-resistant, connection between the ceiling and the wall is intended to remain in place, in order to prevent hazards or even injury to persons and in order, in the event of fire, to prevent the propagation of the fire as well as possible and for as long as possible.

To form a drywall, the wall profile is usually planked with planking panels in a single-layer or double-layer on both sides or on one side. Further planking layers are however readily possible. The latter can contain for example gypsum as a constituent, which in particular can also be suitable for fire protection. Moreover, these planking panels can also be provided with a steel plate, for example in the case of high mechanical horizontal loading. Precisely in case of fire, a sliding ceiling connection can also be provided. However, if the distance between the upper free end of the wall profile and the ceiling profile is increased by the sliding ceiling connection, then the distance of the upper free edges of the planking panels fastened to the wall profile from the ceiling is also increased. An air-permeable gap can thus arise, which breaches the desired fire protection and facilitates and accelerates the spread of fire as a "weak point".

Furthermore, over and above the horizontal loads, not inconsiderable tensile forces occur with drywall constructions, in particular in the case of dynamic loading by wind loads, impact loads or the additional mechanical loading of fire protection structures, and also due to the inherent weight of the wall in connection with the corresponding deformations at the connection. There are no viable solutions in the prior art in particular against such not inconsiderable tensile forces, which therefore leads to a reduction in the level of safety—in the worst case to failure—of the construction.

A connection element mentioned in the prior art for a sliding ceiling connection is disclosed in U.S. Pat. No. 5,040,345. The connection element from the aforementioned publication enables a vertical (floating) movement of a horizontal structure, such as for example a roof element, which is connected to a C-shaped profile (wall profile) in a vertically sliding manner, wherein the connection element is generally U-shaped and has a periphery which corresponds to the inner cross-section of the aforementioned C-profile, including the mutually opposite cutouts, which receive the lips of the C-profile directed inwards, and wherein the connection element is fastened to the horizontal structure. As a result of the sliding enabled by this, the upper free end of the guided wall profile can thus be located at a certain distance from the ceiling. However, in the event of the storey ceiling bending upwards or in the event of corresponding loading of the wall, in particular horizontal loading of the wall, the C-shaped profile can completely slip out of the connection element in this construction, as a result of which the securing of the wall to the ceiling would no longer be present. This is due on the one hand to a short slide path and on the other hand to the fact that the slide path does not have a defined end, beyond which the profile cannot slip out in a loading situation. Corresponding loads can be transferred here only to a limited extent to the building structure.

In the prior art, furthermore, a certain slide path of the wall profile (for example a C-profile) can be achieved (up to 20 mm) for example by using a plaster bar and shortened wall profiles not screwed to the ceiling profile, as described for example in DIN 18183 (2009).

Furthermore, it is possible to fix the wall in its position by means of external brackets. The latter are suitable for taking up greater horizontal loads—but require a not inconsiderable assembly outlay and are optically very conspicuous.

The problem underlying the invention, therefore, is to take better account of a possible relative movement of building components of a drywall construction, in order to achieve improved protection against high mechanical loading, in particular tensile loading, and at the same time loading in terms of fire protection.

According to the invention, this problem is solved by a bracket for connecting building components for a drywall construction, characterised in that the bracket comprises a sole plate, on which the several times folded side wall is fitted orthogonally, which side wall comprises two slots, starting on the side lying opposite the sole plate, for the introduction of a profile, preferably a C-profile, as well as at least one elongated hole for the slidable fastening of the profile.

A bracket or angular bracket in the sense of this application is to be understood as a component used to connect two other components in an orthogonal way.

"Slidable fastening" in the sense of this application is to be understood such that the profile, preferably a C-profile, can be fastened, with a fastening means, preferably a screw, particularly preferably a screw with a nut and at least one washer, in the elongated hole of the side wall of the bracket according to the invention, in such a way that sliding within the slide path, i.e. the length of the elongated hole, is possible under tensile loading.

A simultaneously strain-resistant and slidable wall connection with a, preferably simultaneously, enlarged slide path (at least 20 mm) is thus obtained by this inventive solution, and it is reliably possible, in a surprising way, to permit a defined movement play, i.e. the length of the at least one elongated hole, between a ceiling and planking in the event of high loads, without the wall profile completely slipping out of the bracket and thus causing instability of the wall as such.

It is an essential point of the present invention that the slot is designed such that a profile, preferably a C-profile, can be introduced in a precise and form-fitting manner into the bracket, more precisely into the slots of the bracket. The C-profile can comprise corresponding longitudinal grooves (guides) for advantageous guidance into the slots of the bracket according to the invention. Such a profile preferably has two longitudinal grooves, particularly preferably in the same distance as the slots of the bracket according to the invention. Precise and form-fitting guidance within the slide path can thus also be achieved. A corresponding guidance can be adapted to the most diverse profile sizes and plate thicknesses of the profiles. Overall, the geometry of the bracket according to the invention can be designed such that a high stability both in the wall axis and also orthogonal thereto can be achieved.

Another essential point of the present invention is that very great tensile strength is produced by the stable embodiment of the bracket and therefore also of the direct surroundings of the at least one elongated hole on account of the slidable fastening of the C-profile to the side wall of the bracket according to the invention.

Through the defined, stable limitation of the elongated hole and the stable production of the bracket, for example of steel, preferably galvanised steel, the solution according to the invention has a particularly advantageous effect on the stability of the drywall construction with regard to mechanical loading, very particularly tensile loading.

A further advantage of the invention lies in the secure, precise and form-fitting guidance of the wall profile in the slots of the bracket according to the invention. A vertical guidance of the wall profile in the slots is thus ensured even in the presence of high mechanical loading.

The present solution according to the invention can be used for various drywall systems. Possible examples of this can comprise firewalls (for example for loading with an impact energy of 3,000 J after fire exposure), for taking up the tensile forces induced by the impact, shaft walls for taking up tensile loads from inherent weight in the case of eccentricity, partition walls with large slide paths and/or high horizontal and bracket loads, partial clamping in the case of walls with metal studs and self-supporting sliding ceiling constructions.

The bracket according to the invention could also be used advantageously for the floor-side connection of a wall element to a room floor. If a room ceiling sags, for example in the event of a fire, this is compensated for by the bracket according to the invention as a ceiling profile. However, the sunken ceiling is possibly also the sunken floor of a room above at the same time. A gap could thus also arise in the floor region of the upper room, which could be compensated for with a bracket according to the invention.

The invention and its preferred embodiments are described in detail below.

The at least one elongated hole is used primarily to produce a strain-resistant and at the same time slidable connection between the bracket and a metal framework.

The at least one elongated hole in the side wall of the bracket according to the invention can advantageously lie between the two slots inside the side wall. Moreover, the at least one elongated hole can be provided for receiving at least one fastening means, preferably at least one screw, particularly preferably at least one screw with at least one nut and at least one washer. Furthermore, the at least one elongated hole can advantageously lie within one of the flat surfaces of the multiply folded side wall, which flat surfaces have arisen as a result of the folding. Furthermore, it is preferable that the bracket comprises two or more elongated holes, particularly preferably two elongated holes.

"Fastening means", in the sense of the present application, can simply mean a screw or suchlike, but for example nuts or washers can also be part of a fastening means. For a fastening to a wall or ceiling, as may be the case for example with the sole plate of the bracket, dowels for example can also be included. A set comprising a screw, a nut and at least one washer would for example also be possible as a fastening means.

The side wall of the bracket can advantageously be fitted on the sole plate by welding. It is however also possible for the bracket to be produced in one piece.

The side wall of the bracket could be produced for example by folding of a flat material, in particular a metal plate, several times.

The sole plate and the side wall of the bracket according to the invention can be produced independently of one another from metal, preferably from steel, particularly preferably from (fully) galvanised steel. The metal for the sole plate of the bracket can have a thickness between 0.4 mm and 6 mm, preferably between 1 mm and 6 mm, particularly preferably between 1.5 mm and 6 mm, very particularly preferably between 2 mm and 6 mm. The metal for the side wall of the bracket can have a thickness between 0.4 mm and 6 mm, preferably between 1 mm and 6 mm, particularly preferably between 1.5 mm and 6 mm, very particularly preferably between 2 mm and 6 mm. The sole plate can be constituted stable, in such a way that it can advantageously transfer the vertical loads, bending moments and horizontal loads into the building structure.

Furthermore, the sole plate can advantageously comprise cutouts, for example holes or openings, in particular bores, which can be provided for fastening means, preferably dowels and/or screws. The sole plate can preferably comprise at least two cutouts suitable for fastening means, preferably dowels and/or screws. The sole plate can however also comprise for example four cutouts. The cutouts, however, can be constituted for example round or elongated, depending on what is better suited for receiving the fastening means in the specific embodiment. The cutouts can provide for a very stable connection of the bracket with the profile connected thereto and the ceiling, for example by means of fastening means, preferably screws, driven through the cutouts.

In a preferred embodiment of the bracket according to the invention, the several times folded side wall is folded twice, preferably four times, particularly preferably produced semi-octagonal.

With regard to the invention presented here, "semi-octagonal" means a shape of a flat material, in particular a metal plate, which is folded in this way, wherein the flat material, in order to become semi-octagonal, is folded four times in the same direction out of the plane of the material at different positions of the material parallel to one another and also to a boundary of the material, wherein the outermost flat surfaces of the material are parallel to one another and the four inner angles of the folded material thus arising preferably result in the sum 540°. The positions at which folding takes place can be equidistant from one another. One possible such shape corresponds to a halved convex octagonal, wherein the octagon is halved in two opposite sides and not in two opposite corners.

Moreover, the preferred design of the side wall in its semi-octagonal shape is advantageous, because the terminating surfaces of the side wall of the construction that run parallel to one another offer additional stability.

Furthermore, the several times folded side wall in a preferred embodiment does not project over the base of the sole plate. It is particularly preferable that the several times folded side wall does not project in its width and depth beyond the base of the sole plate, very particularly preferably that three of the flat surfaces arising from the folding terminate flush at three sides of the sole plate with said sole plate. It is still more preferable here that the three flat surfaces of the side wall which terminate flush at the sole plate do not come into contact with one another inside the side wall. Furthermore, the width of the bracket, i.e. the sole plate and the side wall, is constituted such that the corresponding profile to be inserted abuts with its legs against to the two flat surfaces of the side wall lying parallel with one another, so that such an arrangement exhibits a high level of stability.

In a further advantageous embodiment of the bracket according to the invention, there can be sufficient space for the fastening of at least two, preferably four fastening means on the sole plate with every embodiment of the side wall.

Moreover, the slots can in each case lie inside a flat surface of the several times folded side wall. Within the meaning of the invention, however, it is also possible, and could be advantageous in a specific embodiment, that the slots lie at the edge of one of the flat surfaces, or in the edge between two flat surfaces. Furthermore, the slots and the at least one elongated hole can advantageously be aligned with their longitudinal sides parallel with one another and orthogonal to the sole plate. Within the meaning of the present invention, the "slots" can also be understood as elongated holes, which are open towards the end of the respective flat surface of the bracket according to the invention that lies on the opposite side of the sole plate. The slots can advantageously also be constituted such that different sizes and shapes of profiles can be introduced into the bracket and can also be fastened in a slidable manner to at least one elongated hole.

A further advantageous embodiment of the invention is characterised in that the sole plate of the bracket can be provided for fastening to a profile, preferably a U-profile, particularly preferably a ceiling-side U-profile, very particularly preferably a ceiling-side U-profile with longer legs, in the framework of a drywall. Within the meaning of the invention, it may be advantageous that U-profiles with longer legs are used as ceiling profiles (for example UW-profiles). In this way, longer slide paths can be achieved in combination with the respective length of the at least one elongated hole, since the slide path of the corresponding C-profile orthogonal to this U-profile can then be lengthened even further, without the C-profile being able to slip out of the aforementioned U-profile.

Moreover, the side wall of the bracket can be provided, by means of the two slots and the at least one elongated hole, for a slidable fastening to a profile, preferably a C-profile, in the framework of a drywall. The framework of the drywall can be planked, preferably multi-planked. For the planking, use can be made of planking panels, preferably planking panels which contain gypsum as a planking material, particularly preferably planking panels selected from gypsum boards, gypsum plasterboards or gypsum fibreboards. Furthermore, at least one planking panel can be provided with a steel plate in the planking, particularly preferably all the planking panels can be provided in each case with a steel plate. Moreover, the steel plate can have a thickness between 0.1 mm and 2 mm, preferably a thickness of 0.5 mm. The metal plate, preferably the steel plate, can also be laminated directly onto the planking panel. A thickness of 0.4 mm can be preferred here.

A further advantage according to an embodiment of the invention is that, at a point of the drywall construction most important with regard to fire protection and also protection against mechanical loading, i.e. at the height of the at least one elongated hole of the bracket, a layer thickness of preferably three planking panels reinforced with steel plates, two metal profile thicknesses and the thickness of the one flat surface of the bracket can be provided on each side of the wall. This leads to great stability at said point and therefore for the entire drywall construction.

In a further preferred embodiment, the at least one elongated hole can limit the slide path of the profile, preferably a C-profile, which can be introduced into the two slots of the bracket, to the length of said at least one elongated hole by means of at least one fastening means, which can be anchored through the web of the profile, preferably a C-profile, in said at least one elongated hole. Tensile loads in particular can thus be taken up in an improved manner.

Moreover, it is preferable that the sole plate of the bracket can be fastened, preferably screwed, to the ceiling through the web of a profile, preferably the web of a U-profile.

In a further preferred embodiment, the width of the sole plate is designed such that it can completely fill the width of the web between the two flanges of the profile on which it can be fastened. The sole plate can thus be positioned in the optimum manner during assembly.

Furthermore, it is preferable that the outermost folded flat surfaces of the side wall can be constituted such that they are aligned in parallel with the flanges of a profile, preferably in a C-profile, which can be introduced into the slots, and can completely fill the width of the web of the introduced profile, preferably the C-profile.

Some of the sizes, size ratios and parameters for embodiments of the bracket according to the invention, which could be advantageously taken into account, are stated below solely by way of example.

The side wall of the bracket can have a height between 8 cm and 30 cm, preferably between 10 cm and 25 cm, particularly preferably between 12 cm and 20 cm.

The slots, starting from the end of the side wall that lies opposite the sole plate, can have a length of between 4 cm and 25 cm, preferably between 6 cm and 20 cm, particularly preferably between 8 cm and 15 cm.

The at least one elongated hole can have a length of between 20 mm and 150 mm, preferably between 30 mm and 100 mm, particularly preferably between 40 mm and 80 mm, wherein the at least one elongated hole can have a distance from the end of the side wall lying opposite the sole plate of between 2 mm and 30 mm, preferably between 4 mm and 25 mm, particularly preferably between 8 mm and 20 mm.

The size data mentioned here of the individual features of the bracket are preferably related to one another. Moreover, it is for example possible for the ratio of the height of the side wall to the length of the sole plate to be 14:9.

The ratios of the aforementioned size data can also prove advantageous for other magnitudes.

Provision is preferably made such that the profiles (U-profiles and/or C-profiles) are made of metal plate. In particular, the metal plate can have a thickness of approximately 0.6 mm.

In addition, the bracket according to the invention, as well as the aforementioned profiles, can be provided with a fire protection material, preferably with a fire protection material that is intumescent in the event of fire, which fire protection material is applied for example as a paint, a coating or putty.

Independent protection is also claimed for an assembly kit for a drywall with a planked framework, preferably a multi-planked framework, which is characterised by at least one bracket according to the invention.

A corresponding assembly kit can comprise for example U- and C-profiles, at least one, preferably a plurality of brackets according to the invention, various fastening means and planking panels.

An assembly kit for a drywall with a planked framework, preferably a multi-planked framework, which is characterised in that a bracket according to the invention is provided on each wall profile, is particularly advantageous.

Another development of the assembly kit according to the invention consists in the fact that two brackets according to the invention are provided on each wall profile (for example a C-profile), wherein a bracket is provided at the upper end and a bracket at the lower end of the profile.

A preferred development of the assembly kit according to the invention is characterised in particular in that at least double-planking is provided on the framework, wherein a first and a second planking consist in each case of two parts, wherein each first part is fastened to the profile fastened to the sole plate of the bracket and each second part is fastened to the profile fastened to the side wall of the bracket, wherein the heights of the two parts of the first and second planking are different, such that the passage of air through the double-planking in each position of the slide path is blocked within the slide path of the profile fastened to the side wall of the bracket, said slide path being defined by the at least one elongated hole.

Although it is not absolutely necessary with the bracket according to the invention, the assembly kit according to the invention can be characterised according to a development of the invention in that a third planking is provided on the profile fastened to the sole plate of the bracket, which planking has at least the height of the bracket added to the length of the at least one elongated hole and blocks the passage of air from outside to the second planking within the slide path defined by the at least one elongated hole.

Independent protection is also claimed for a drywall according to the invention, which is characterised in that it comprises at least one bracket according to the invention.

Independent protection is also claimed for a drywall according to the invention, which is characterised in that it is constructed from an assembly kit according to the invention and comprises at least one bracket according to the invention.

Independent protection is also claimed for the use of at least one bracket according to the invention.

Figure 2:
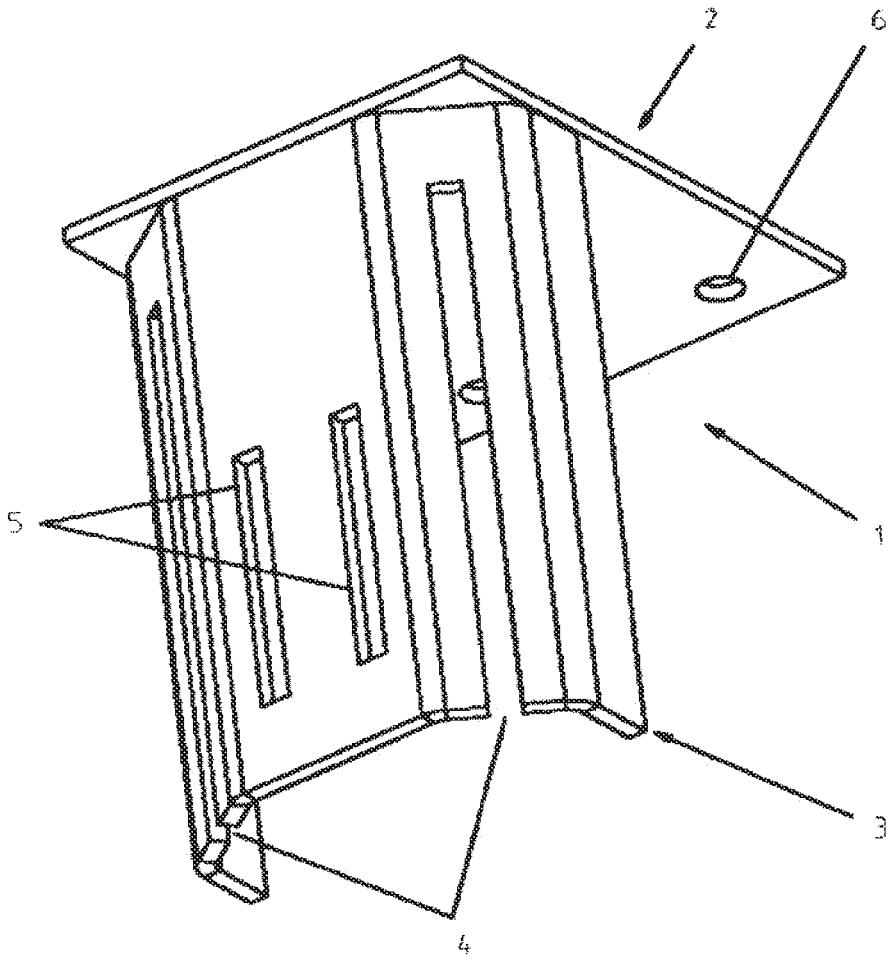
Figure 3:
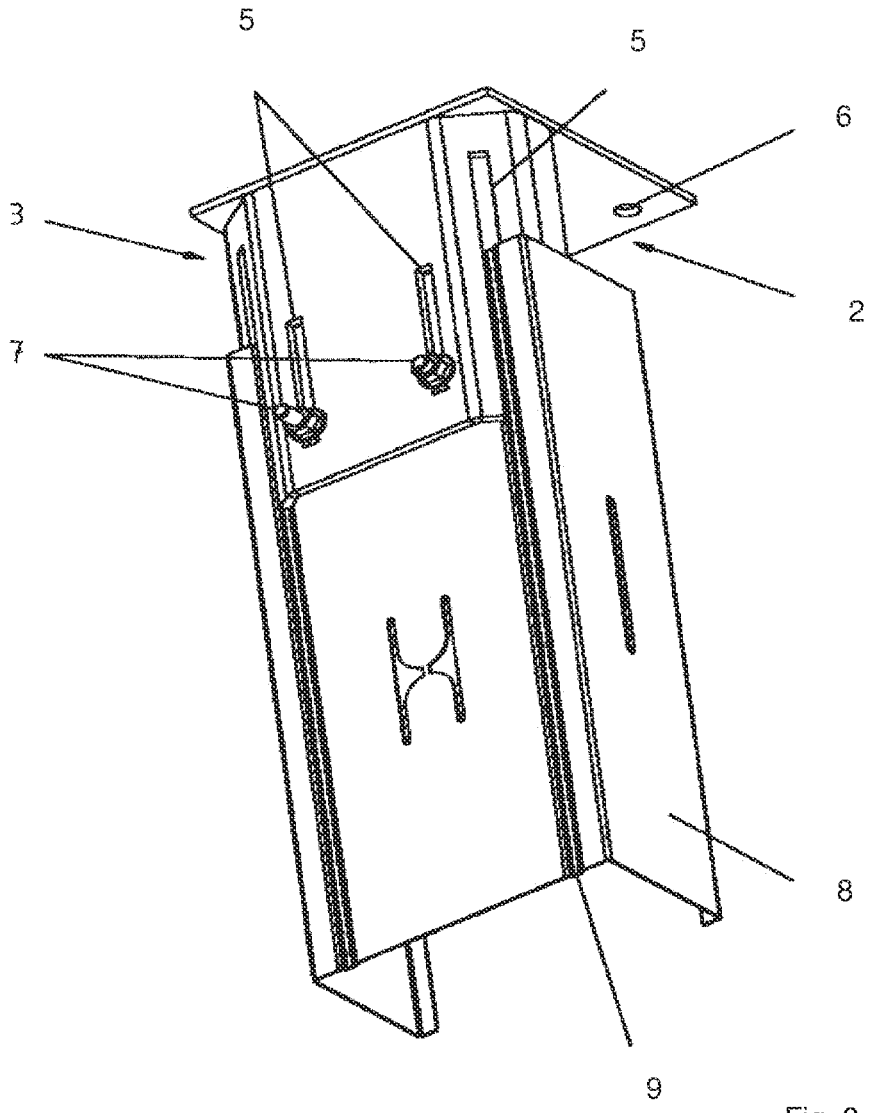
Figure 4:
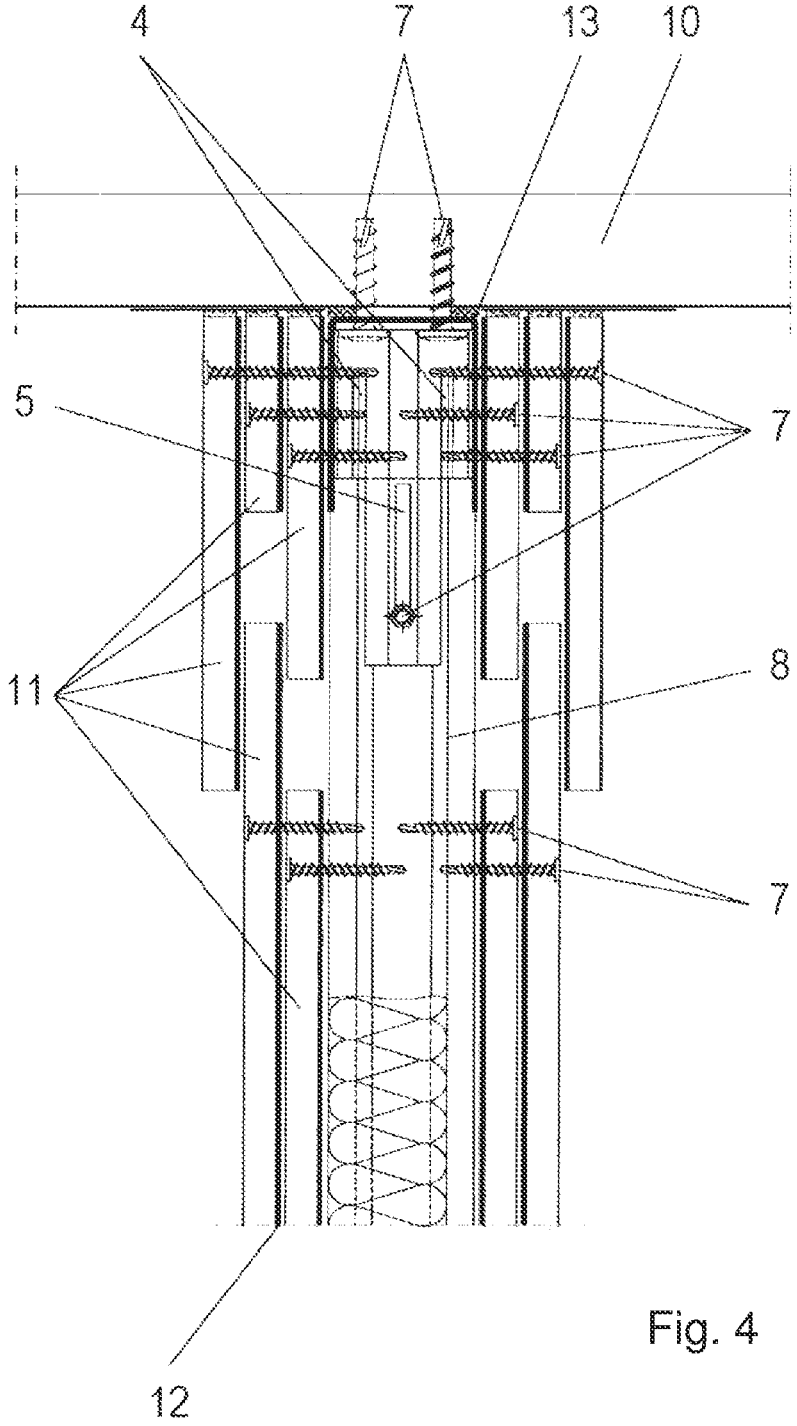

Examples of the embodiments, from which further inventive features can emerge, but which are basically to be regarded merely as being by way of example and which are not intended to limit the subject-matter of the invention or its scope of protection, are represented in the figures. The reference numbers are identical for all the figures. In the figures:

FIG. 1 shows a perspective view of a bracket according to the invention with one elongated hole, FIG. 2 shows a perspective view of a bracket according to the invention with two elongated holes, FIG. 3 shows a perspective view of a bracket according to the invention with two elongated holes according to FIG. 2 with an introduced and slidably fastened C-profile, FIG. 4 shows a cross-sectional view of a bracket according to the invention according to FIG. 1 as a connection element in a multi-planked drywall.

FIG. 1 shows a perspective view of a bracket according to the invention with one elongated hole.

The bracket (1) comprises a sole plate (2) and a side wall (3) fastened to the latter. The side wall (3) is folded four times and comprises the two slots (4) and an elongated hole (5) in the middle three of the five flat surfaces, wherein the middle flat surface comprises the elongated hole (5). The sole plate (2) comprises four cutouts (6) over the free region of the sole plate (2) for receiving the fastening means (7).

FIG. 2 shows a perspective view of the bracket according to the invention with two elongated holes.

FIG. 2 differs from FIG. 1 solely in that the middle flat surface of the side wall (3) is larger than in FIG. 1, and two parallel elongated holes (5) are located therein.

FIG. 3 shows a perspective view of a bracket (1) according to the invention with two elongated holes (5) according to FIG. 2 with an introduced and slidably fastened C-profile (8).

The C-profile (8) is fastened, preferably with the aid of the guides or longitudinal grooves (9) of the C-profile (8), in the two elongated holes (5) and so as to be slidable with the aid of the fastening means (7), here screws with nuts and washers, so that the C-profile (8) is held stable in the bracket (1) on the one hand by slots (4) and on the other hand by the fastening means (7), but nonetheless can, for example under tensile load, make use of the slide path in a precise and form-fitting manner, without slipping too far out of the U-profile (13, not shown).

FIG. 4 shows a cross-sectional view of a bracket according to the invention according to FIG. 1 as a ceiling profile of a triple-planked drywall.

In particular, FIG. 4 shows a cross-sectional view of a bracket (1) according to the invention with a maximum distance of the C-profile (8) from the ceiling (10) within the slide path. In this regard, it can be seen in FIG. 4 that, through the maximum use of the slide path within the elongated hole (5) of the bracket (1), no gap for the passage of air between the ceiling (10) and the planking panels (11) reinforced with steel plates (12) is opened on account of the limited elongated hole (5) and therefore a fire protection is not breached, whilst the construction continues to be secured against tensile loads by the stable embodiment of the bracket (1) according to the invention.

For the sake of completeness, it should be mentioned at this point that the representations of FIGS. 1-4, when turned upside down, would illustrate the circumstances as how a profile according to the invention would look and could be used, if it were to be used correspondingly for the connection of a wall at its foot to a room floor, which, at all events in sections, could certainly be possible and advantageous.

Geometrical terms such as parallel, orthogonal or semi-octagonal as well as the indications of sizes of for example inner angles are to be understood, within the meaning of this application, as essentially parallel, orthogonal or semi-octagonal. Smaller deviations, such as can be tolerated in the production, processing and use of such materials, are also covered by these terms.

The invention claimed is:

1. A bracket for connecting components for a drywall construction, characterised in that the bracket comprises a sole plate, on which a several times folded side wall is fitted orthogonally, which side wall comprises two slots, starting on a side wall end lying opposite the sole plate, for the introduction of a profile, as well as at least one elongated hole for a slidable fastening of the profile, wherein said folded side wall is folded several times around the same direction orthogonal from the sole plate and out of a plane of a material at different positions of the material parallel to one another and also to a boundary of the material.

2. The bracket according to claim 1, characterised in that the at least one elongated hole lies between the two slots and/or that the at least one elongated hole is provided for receiving at least one fastening means, and/or that the at least one elongated hole lies within one of the flat surfaces of the several times folded side wall, which flat surfaces have arisen as a result of the folding.

3. The bracket according to claim 1, characterised in that the at least one elongated hole limits the slide path of a profile which has been introduced into the two slots of the bracket, to the length of said at least one elongated hole by means of at least one fastening means, which is anchored through the web of the profile, in said at least one elongated hole.

4. The bracket according to claim 1, characterised in that the side wall of the bracket is fitted on the sole plate by welding or that the bracket is produced in one piece.

5. The bracket according to claim 1, characterised in that the several times folded side wall is folded twice, and/or that the several times folded side wall does not project in its width and depth beyond the base of the sole plate.

6. The bracket according to claim 1, characterised in that the sole plate of the bracket is provided fastened to a profile.

7. The bracket according to claim 6, characterised in that the framework of the drywall is planked.

8. The bracket according to claim 7, characterised in that, for the planking, use is made of planking panels, and/or that at least one planking panel is provided with a steel plate in the planking and that the steel plate has a thickness between 0.1 mm and 2 mm.

9. The bracket according to claim 6, characterised in that the sole plate of the bracket is fastened to the ceiling through the web of a profile, and/or the width of the sole plate is designed such that it completely fills the width of the web between the two flanges of the profile on which it is fastened, and/or that the outermost folded flat surfaces of the side wall are constituted such that they are aligned in parallel with the flanges of a profile, which can be introduced into the slots, and completely fill the width of the web of the introduced profile.

10. The bracket according to claim 1, characterised in that the bracket comprises two or more elongated holes.

11. The bracket according to claim 1, characterised in that the sole plate and/or the side wall of the bracket is/are produced from steel, and that the steel for the sole plate and/or the side wall of the bracket has a thickness between 0.4 mm and 6 mm.

12. The bracket according to claim 1, characterised in that the sole plate is provided with at least two cutouts, provided for fastening means.

13. The bracket according to claim 1, characterised in that the side wall of the bracket is provided, by means of the two slots and the at least one elongated hole, for a slidable fastening to a profile, in the framework of a drywall.

14. An assembly kit of a drywall with a planked framework, characterised by at least one bracket according to claim 1.

15. The assembly kit according to claim 14, characterised in that at least double-planking is provided on the framework, wherein a first and a second planking consist in each case of two parts, wherein each first part is fastened to the profile fastened to the sole plate of the bracket and each second part is fastened to the profile fastened to the side wall of the bracket, wherein the heights of the two parts of the first and second planking are different, such that the passage of air through the double-planking in each position of the slide path is blocked within the slide path of the profile fastened to the side wall of the bracket, said slide path being defined by the at least one elongated hole.

16. The assembly kit according to claim 15, characterised in that a third planking is provided on the profile fastened to the sole plate of the bracket, which planking has at least the height of the bracket added to the length of the at least one elongated hole and blocks the passage of air from outside to the second planking within the slide path defined by the at least one elongated hole.

17. A drywall, characterised in that it is constructed from an assembly kit according to claim 14.

18. Use of at least one bracket according to claim 1 in drywall construction.

19. The bracket according to claim 1, characterised in that the profile is a C-profile.

20. The bracket according to claim 5, wherein the several times folded side wall is folded four times, and produced semi-octagonal, and/or the several times folded side wall does not project in its width and depth beyond the base of the sole plate, such that three of the flat surfaces arising from the folding terminate flush at three sides of the sole plate with said sole plate and do not come into contact with one another inside the side wall and/or that the slots in each case lie inside a flat surface of the several times folded side wall and/or that the slots and the at least one elongated hole are aligned with their longitudinal sides parallel with one another and orthogonal to the sole plate.

21. The bracket according to claim 8, wherein, for the planking, use is made of planking panels selected from gypsum boards, gypsum plasterboards or gypsum fibreboards and/or that all the planking panels are provided in each case with a steel plate, and that the steel plate has a thickness of 0.5 mm.

* * * * *